US006806764B2

(12) United States Patent
Inagaki et al.

(10) Patent No.: US 6,806,764 B2
(45) Date of Patent: Oct. 19, 2004

(54) REFERENCE VOLTAGE GENERATION CIRCUIT

(75) Inventors: Yoshitsugu Inagaki, Osaka (JP); Koji Oka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/307,446

(22) Filed: Dec. 2, 2002

(65) Prior Publication Data

US 2003/0076160 A1 Apr. 24, 2003

Related U.S. Application Data

(62) Division of application No. 09/778,066, filed on Feb. 7, 2001, now Pat. No. 6,498,528.

(30) Foreign Application Priority Data

Feb. 8, 2000 (JP) ..... 2000-030051

(51) Int. Cl.[7] ..... G05F 1/10; G05F 3/02
(52) U.S. Cl. ..... 327/543; 327/541
(58) Field of Search ..... 327/538, 540, 327/541, 543; 323/312, 315, 316

(56) References Cited

U.S. PATENT DOCUMENTS

| | | | | |
|---|---|---|---|---|
| 4,051,392 A | * | 9/1977 | Rosenthal et al. | 327/581 |
| 5,109,187 A | | 4/1992 | Guliani | 323/315 |
| 5,334,928 A | | 8/1994 | Dobkin et al. | 323/280 |
| 5,453,679 A | | 9/1995 | Rapp | 323/313 |
| 5,675,239 A | | 10/1997 | Kim et al. | 327/273 |
| 5,686,824 A | | 11/1997 | Rapp | 323/313 |
| 5,694,073 A | | 12/1997 | Coots et al. | 327/362 |
| 5,696,440 A | | 12/1997 | Harada | 323/313 |
| 5,754,037 A | | 5/1998 | Ezell et al. | 323/273 |
| 5,814,980 A | | 9/1998 | Lewis | 323/311 |
| 5,825,237 A | | 10/1998 | Ogawa | 327/454 |
| 5,847,597 A | | 12/1998 | Ooishi et al. | 327/543 |
| 5,969,549 A | | 10/1999 | Kim et al. | 327/143 |
| 6,002,244 A | | 12/1999 | Wrathall | 323/315 |
| 6,160,392 A | | 12/2000 | Shin | 323/284 |

FOREIGN PATENT DOCUMENTS

| | | |
|---|---|---|
| JP | 59143407 | 8/1974 |
| JP | 05-297969 | 11/1993 |
| JP | 06-028048 | 2/1994 |
| JP | 07-121255 | 5/1995 |
| JP | 07-230331 | 8/1995 |
| JP | 09-146647 | 6/1997 |
| JP | 10-078827 | 3/1998 |

* cited by examiner

*Primary Examiner*—Quan Tra
(74) *Attorney, Agent, or Firm*—McDermott, Will & Emery LLP

(57) ABSTRACT

A start-up section is made up of an input transistor configured to receive at its gate a voltage at a node which varies with the magnitude of a current flowing in one branch of a current mirror in a reference voltage generation section, an inverter for reversing a drain voltage of the input transistor, an output transistor for supplying a start-up current to the reference voltage generation section in response to an output voltage from the inverter, and a current limit transistor serially connected to the input transistor. The current limit transistor receives a reduced gate-source voltage from the reference voltage generation section for limiting a flow of current in the input transistor upon completion of restarting the reference voltage generation section.

1 Claim, 3 Drawing Sheets

REFERENCE VOLTAGE GENERATION CIRCUIT

This application is a divisional of application Ser. No. 09/778,066, filed Feb. 7, 2001 now U.S. Pat. No. 6,498,528.

BACKGROUND OF THE INVENTION

The present invention relates to a reference voltage generation circuit which finds applications in semiconductor integrated circuits and which includes a low power consumption start-up section for restarting a reference voltage generation section of the reference voltage generation circuit.

The reference voltage generation circuit is an important circuit having a variety of applications. A reference voltage generation circuit has been known in the art which has a reference voltage generation section for generating a reference voltage and a start-up section for restarting the reference voltage generation section. With such a configuration, even when the reference voltage generation section accidentally goes into the off state when the power is applied or due to influence of some kind caused by noise or the like, it is possible for the reference voltage generation section to restart and generate a normal reference voltage.

As long as the reference voltage generation section keeps operating normally, the start-up section stands by in the idle state, in other word the start-up section is not required to operate. However, if current continuously flows, in a steady-state manner, in the start-up section, this will introduce a problem that power consumption is greatly increased. U.S. Pat. No. 5,969,549 shows a solution to cope with the problem.

SUMMARY OF THE INVENTION

Accordingly, like the above-mentioned US patent, an object of the present invention is to lower power consumption of a reference voltage generation circuit by reducing, after the reference voltage generation section is started up, stationary current flowing in the start-up section.

In order to achieve the object, the present invention employs the following start-up section configurations for use in reference voltage generation circuits comprising a reference voltage generation section having a current mirror and configured to generate a reference voltage and a start-up section for restarting the reference voltage generation section.

A first reference voltage generation circuit of the present invention is provided with a start-up section, the start-up section including an input transistor configured to receive at its gate a voltage at a node which varies with the magnitude of a current flowing in one branch of the current mirror in the reference voltage generation section, an inverter for reversing a drain voltage of the input transistor, an output transistor for supplying a start-up current to the reference voltage generation section in order to restart the reference voltage generation section in response to an output voltage from the inverter, and a current limit transistor serially connected to the input transistor in order to receive from the reference voltage generation section a reduced gate-source voltage upon completion of restarting the reference voltage generation section for limiting a flow of current in the input transistor.

A second reference voltage generation circuit of the present invention is provided with a start-up section, the start-up section including input transistors of first and second polarities which receive at their respective gates a voltage at a node which varies with the magnitude of a current flowing in one branch of the current mirror in the reference voltage generation section and which are connected together drain to drain, and an output transistor for increasing a gate-source voltage common to two transistors together forming the current mirror in order to restart the reference voltage generation section in response to a voltage common to the drains of these input transistors of the first and second polarities.

A third reference voltage generation circuit of the present invention is provided with a start-up section, the start-up section including an input transistor configured to receive at its gate a voltage at a node which varies with the magnitude of a current flowing in one branch of the current mirror in the reference voltage generation section, an inverter for reversing a drain voltage of the input transistor, an output transistor for supplying a start-up current to the reference voltage generation section in order to restart the reference voltage generation section in response to an output voltage from the inverter, a switch serially connected to the input transistor in order to cut off a flow of current in the input transistor upon completion of restarting the reference voltage generation section, and a control transistor for receiving at its gate the same voltage as a voltage at the input transistor gate to shift an input voltage of the inverter, in order to cut off the start-up current which has been supplied from the output transistor upon completion of restarting the reference voltage generation section.

A fourth reference voltage generation circuit of the present invention is provided with a start-up section, the start-up section including an input transistor configured to receive at its gate a voltage at a node which varies with the magnitude of a current flowing in one branch of the current mirror in the reference voltage generation section, an inverter for reversing a drain voltage of the input transistor, an output transistor for supplying a start-up current to the reference voltage generation section in order to restart the reference voltage generation section in response to an output voltage from the inverter, a first switch for disconnecting the input transistor gate from the node in the reference voltage generation section upon completion of restarting the reference voltage generation section, a first control transistor for receiving at its gate the same voltage as a voltage which has been received at the input transistor gate to shift the input transistor gate voltage, in order to cut off a flow of current in the input transistor upon completion of restarting the reference voltage generation section, a second switch for disconnecting an input of the inverter from a drain of the input transistor upon completion of restarting the reference voltage generation section, and a second control transistor for receiving at its gate the same voltage as a voltage which has been received at the input transistor gate to shift an input voltage of the inverter, in order to cut off the start-up current which has been supplied from the output transistor upon completion of restarting the reference voltage generation section.

A fifth reference voltage generation circuit of the present invention is provided with a start-up section, the start-up section including a transistor for receiving at its gate a voltage at a node which varies with the magnitude of a current flowing in one branch of the current mirror in the reference voltage generation section, and for supplying a start-up current to the reference voltage generation section in order to restart the reference voltage generation section in response to the voltage. Further, a voltage lower than a power supply voltage of the reference voltage generation section is applied to a source of the transistor.

DETAILED DESCRIPTION OF THE INVENTION

Embodiments of the present invention will be described below with reference to the drawings.

Embodiment 1

Figure 1:
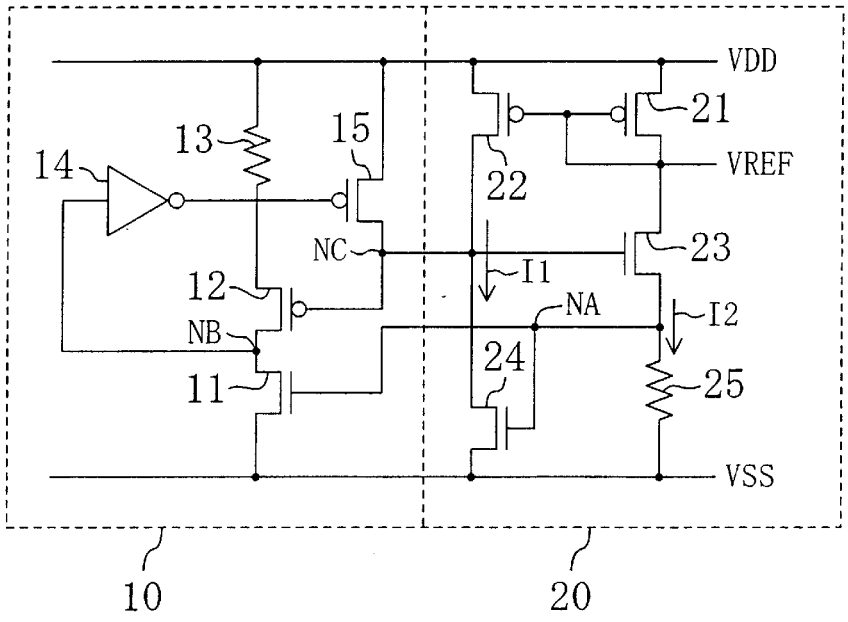
FIG. 1 is a circuit diagram of a reference voltage generation circuit in accordance with a first embodiment of the present invention.

FIG. 1 shows that a reference voltage generation circuit of a first embodiment of the present invention is made up of a start-up section 10 and a reference voltage generation section 20.

The reference voltage generation section 20 is made up of two PMOS transistors 21 and 22, two NMOS transistors 23 and 24, and a resistor 25. The gate and the drain of the PMOS transistor 21 are connected to an output terminal for a reference voltage VREF and the source of the PMOS transistor 21 is connected to a power supply VDD. The gate, the drain, and the source of the PMOS transistor 22 are connected to the VREF output terminal, to a node NC, and to the power supply VDD, respectively. The PMOS transistors 21 and 22 together form a current mirror. The gate, the drain, and the source of the NMOS transistor 23 are connected to the node NC, to the VREF output terminal, and to a node NA, respectively. The gate, the drain, and the source of the NMOS transistor 24 are connected to the node NA, to the node NC, and to a power supply VSS (ground power supply), respectively. The resistor 25 is connected between the node NA and the power supply VSS. The start-up section 10 is made up of an NMOS transistor 11, two PMOS transistors 12 and 15, a resistor 13, and an inverter 14. The gate, the drain, and the source of the NMOS transistor 11 are connected to the node NA, to a node NB, and to the power supply VSS, respectively. The gate and the drain of the PMOS transistor 12 are connected to the node NC and to the node NB, respectively, and the source of the PMOS transistor 12 is connected, through the resistor 13, to the power supply VDD. The inverter 14 is disposed to reverse a voltage at the node NB. The gate, the drain, and the source of the PMOS transistor 15 are connected to an output of the inverter 14, to the node NC, to the power supply VDD, respectively.

The operation of the present reference voltage generation circuit will be described below. First, when the power is applied, in the reference voltage generation section 20 a current I1 flows in a series circuit of the PMOS transistor 22 and the NMOS transistor 24, and the gate-source voltage (Vgs) of the NMOS transistor 24 is determined. Further, a current I2 flows in a series circuit of the PMOS transistor 21, the NMOS transistor 23, and the resistor 25, and a voltage (I2×R) is generated across the resistor 25. These voltages, i.e., Vgs and I2×R, are connected together, therefore creating two voltage balance points. One is a ground voltage balance point and the other is a normal VREF balance point. When the reference voltage VREF becomes the ground voltage, no current will flow in the reference voltage generation section 20. As a result, the reference voltage generation section 20 stops operating. The start-up section 10 is then required for the reference voltage generation section 20 to return to its normal operation state.

When the reference voltage generation section 20 is in the abnormal operation condition, the start-up section 10 functions so that the reference voltage generation section 20 is able to return again to its normal operation condition. After the power is applied, no current will flow in the reference voltage generation section 20 in the abnormal condition, thereby causing the node NA at the side of one end of the resistor 25 to approach the ground voltage. Further, the gate-source voltage of the NMOS transistor 24 diminishes, so that no current will flow in the NMOS transistor 24. At this time the voltage of the node NA is also the gate voltage of the NMOS transistor 11, so that the NMOS transistor 11 also tends to enter the cut-off state. As a result, the voltage of the node NB increases and the output voltage of the inverter 14 decreases. Therefore, the gate-source voltage of the PMOS transistor 15 increases, thereby placing the PMOS transistor 15 in the conductive state, and current starts flowing in the PMOS transistor 15. This generates a gate-source voltage for the NMOS transistor 23 and current starts flowing also in the reference voltage generation section 20. During this state, the reference voltage generation section 20 is operating normally and therefore the start-up section 10 stands by in the idle state. At this time, the gate of the PMOS transistor 12 of the start-up section 10 is connected to the node NC and the voltage value of the node NC will increase, so that the gate-source voltage of the PMOS transistor 12 diminishes. As a result, the on resistance of the PMOS transistor 12 diminishes, thereby limiting the flow of current in the NMOS transistor 11. Accordingly, the present embodiment makes it possible to reduce the current of the start-up section 10 when the start-up section 10 stands by in the idle state, thereby allowing the realization of reference voltage generation circuits with low power consumption.

Embodiment 2

Figure 2:
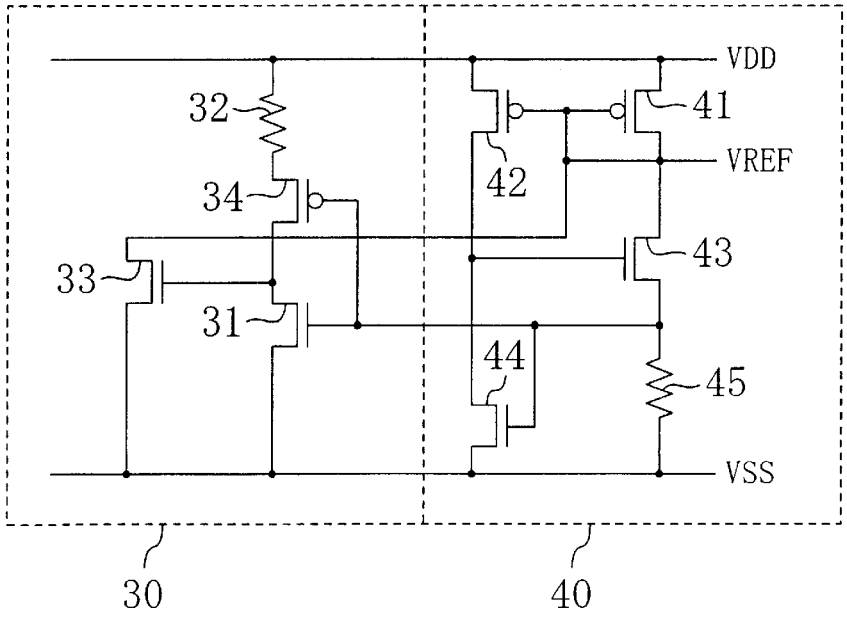
FIG. 2 is a circuit diagram of a reference voltage generation circuit in accordance with a second embodiment of the present invention.

Based on FIG. 2, a second embodiment of the present invention will be described below. FIG. 2 is a circuit diagram showing a configuration of a reference voltage generation circuit in accordance with the second embodiment. The present embodiment is characterized in that it employs a different configuration for the start-up section from the first embodiment. That is, a start-up section 30 of the present embodiment is made up of two NMOS transistors 31 and 33, a resistor 32, and a PMOS transistor 34. Like the first embodiment, a reference voltage generation section 40 of the present embodiment has a configuration constructed of two PMOS transistors 41 and 42, two NMOS transistors 43 and 44, and a resistor 45.

As in the first embodiment, when there occurs an abnormally balanced condition after the power is applied, the current value of the reference voltage generation section 40 diminishes and, as a result, the gate voltage of the NMOS transistor 44 falls. Since the gate of the NMOS transistor 44 is common to the NMOS transistor 31 and to the PMOS transistor 34, the current value of the NMOS transistor 31 decreases and the current value of the PMOS transistor 34 increases. Accordingly, the gate voltage of the NMOS transistor 33 gradually increases and the NMOS transistor 33 enters the on state to cause current to start flowing. The drain of the NMOS transistor 33 is connected to the gates of the PMOS transistors 41 and 42 together forming a current mirror of the reference voltage generation section 40, thereby causing their gate voltage to fall. This turns on the PMOS transistors 41 and 42 and, as a result, the reference voltage generation section 40 is started up, whereby the reference voltage VREF can be generated normally. On the other hand, when the start-up section 30 stands by in the idle state, the gate voltage of the NMOS transistor 31 increases up to such an extent that the on state is reached and, as a result, the gate voltage of the NMOS transistor 33 falls and the NMOS transistor 33 enters the cut-off state. Further, the gate voltage of the PMOS transistor 34 also increases and its on resistance increases, thereby making it possible to limit the current flowing in the NMOS transistor 31. Accordingly, the present embodiment also makes it possible to reduce the current of the start-up section 30 when the start-up section 30 stands by in the idle state, thereby allowing the realization of reference voltage generation circuits with low power consumption.

Embodiment 3

Figure 3:
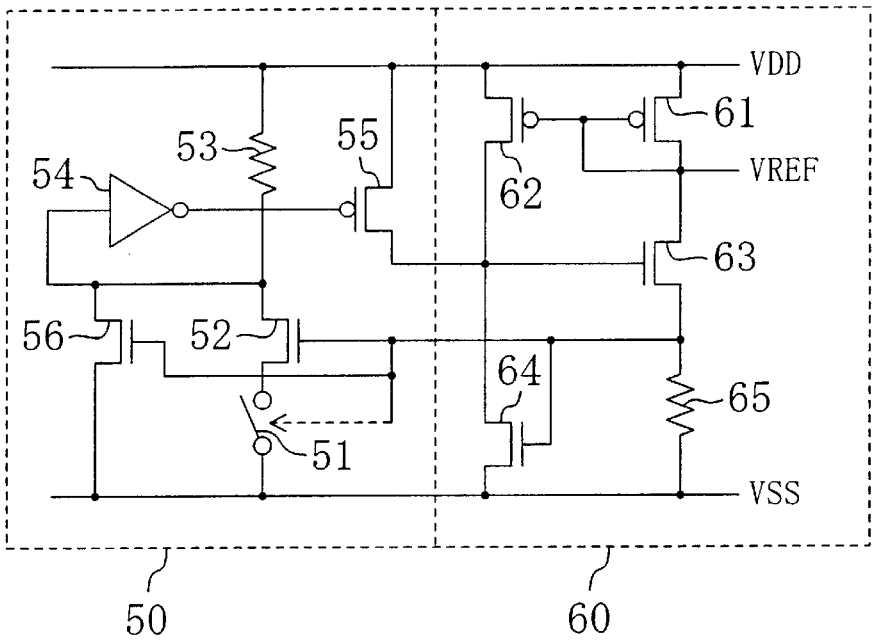
FIG. 3 is a circuit diagram of a reference voltage generation circuit in accordance with a third embodiment of the present invention.

Based on FIG. 3, a third embodiment of the present invention will be described below. FIG. 3 is a circuit diagram showing a configuration of a reference voltage generation circuit in accordance with the third embodiment. The present embodiment is characterized in that it employs a different configuration for the start-up section from the second embodiment. That is, a start-up section 50 of the present embodiment is made up of a switch 51, two NMOS transistors 52 and 56, a resistor 53, an inverter 54, and a PMOS transistor 55. Like the second embodiment, a reference voltage generation section 60 of the present embodiment has a configuration constructed of two PMOS transistors 61 and 62, two NMOS transistors 63 and 64, and a resistor 65.

As in the second embodiment, in the present embodiment, when there occurs an abnormally balanced condition after the power is applied, the current value of the reference voltage generation section 60 diminishes and, as a result, the gate voltage of the NMOS transistor 64 falls. The gate voltage of the NMOS transistor 52 approaches the ground voltage and the NMOS transistor 52 enters the cut-off state because the switch 51 is closed. In this case, the drain voltage of the NMOS transistor 52 is connected to an input of the inverter 54 and therefore the gate voltage of the PMOS transistor 55 falls to cause the PMOS transistor 55 to enter the conductive state, and current starts flowing in the PMOS transistor 55. This increases the gate voltage of the NMOS transistor 63, causing current to start flowing in the reference voltage generation section 60. In such a state, the reference voltage VREF is generated normally in the reference voltage generation section 60 and therefore the start-up section 50 is made to stand by in the idle state. At this time, the switch 51 is in the open state and the current of the start-up section 50 is completely cut off. Further, the NMOS transistor 56 is placed in the conductive state and therefore the input voltage of the inverter 54 approaches the ground voltage, and the PMOS transistor 55 enters the cut-off state. Accordingly, the present embodiment also makes it possible to reduce the current of the start-up section 50 when the start-up section 50 stands by in the idle state, thereby allowing the realization of reference voltage generation circuits with low power consumption.

Embodiment 4

Figure 4:
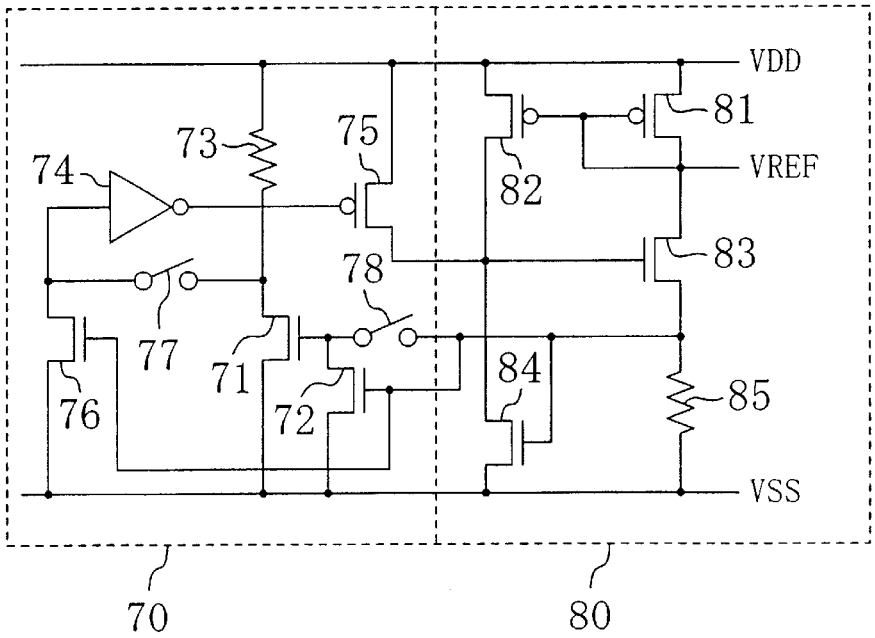
FIG. 4 is a circuit diagram of a reference voltage generation circuit in accordance with a fourth embodiment of the present invention.

Based on FIG. 4, a fourth embodiment of the present invention will be described below. FIG. 4 is a circuit diagram showing a configuration of a reference voltage generation circuit in accordance with the fourth embodiment. The present embodiment is characterized in that it has a different configuration for the start-up section from the third embodiment. That is, a start-up section 70 of the present embodiment is made up of three NMOS transistors 71, 72, and 76, a resistor 73, an inverter 74, a PMOS transistor 75, and two switches 77 and 78. Like the third embodiment, a reference voltage generation section 80 of the present embodiment has a configuration constructed of two PMOS transistors 81 and 82, two NMOS transistors 83 and 84, and a resistor 85.

As in the third embodiment, in the present embodiment, when there occurs an abnormally balanced condition, the current value of the reference voltage generation section 80 diminishes and, as a result, the gate voltage of the NMOS transistor 84 falls. At this time, the switch 78 enters the closed state and the NMOS transistors 72 and 76 enter the cut-off state because the gate of each NMOS transistor 72 and 76 is common to the NMOS transistor 84. In this case, the switch 77 is also closed and no current flows in the NMOS transistor 71 and the PMOS transistor 75 enters the conductive state. This causes current to start flowing in the PMOS transistor 75. Because of this, the gate voltage of the NMOS transistor 83 increases and current starts flowing in the reference voltage generation section 80. In this state, the start-up section 70 stands by in the idle state. At this time, in the start-up section 70, the switches 77 and 78 enter the open state and the NMOS transistors 72 and 76 enter the conductive state. As a result, the gate voltage of the NMOS transistor 71 approaches the ground voltage and the NMOS transistor 71 is cut off. Further, at this time, the input voltage of the inverter 74 also becomes the ground voltage, therefore placing the PMOS transistor 75 in the cut-off state. Accordingly, the present embodiment also makes it possible to reduce the current of the start-up section 70 when the start-up section 70 stands by in the idle state, thereby allowing the realization of reference voltage generation circuits with low power consumption.

Embodiment 5

Figure 5:
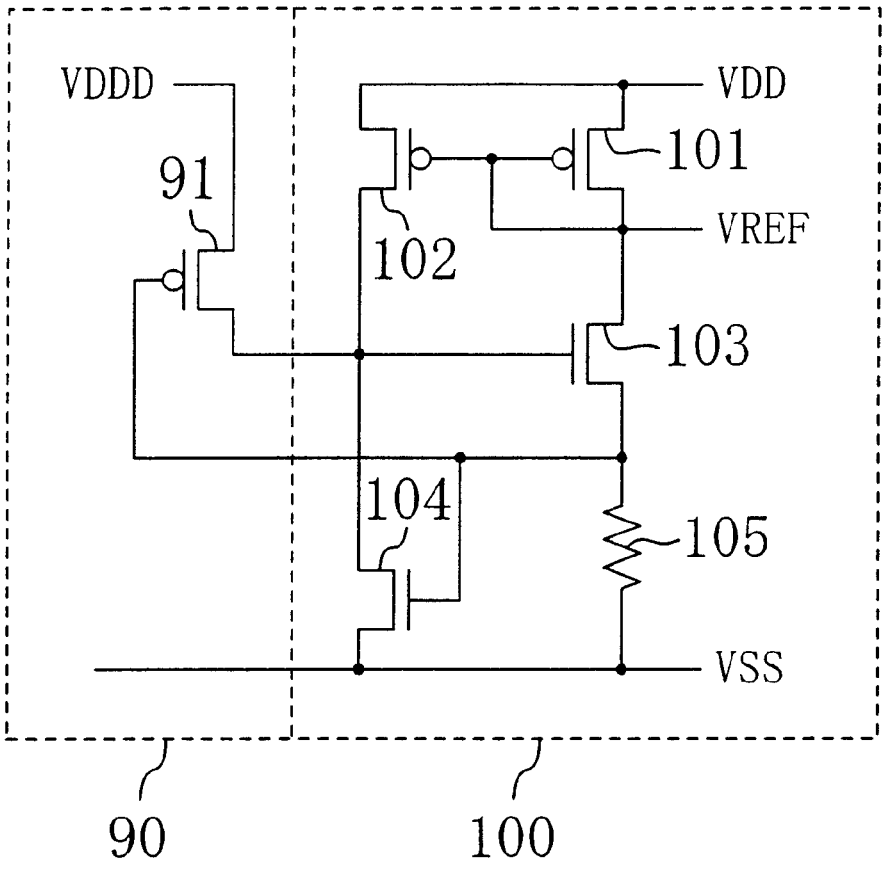
FIG. 5 is a circuit diagram of a reference voltage generation circuit in accordance with a fifth embodiment of the present invention.

Based on FIG. 5, a fifth embodiment of the present invention will be described below. FIG. 5 is a circuit diagram showing a configuration of a reference voltage generation circuit in accordance with the fifth embodiment. The present embodiment is characterized as follows. That is, a start-up section 90 of the present embodiment is implemented by only a PMOS transistor 91 and the source of the PMOS transistor 91 is connected to a power supply VDDD of sufficiently low voltage unlike the power supply VDD of a reference voltage generation section 100. Like the fourth embodiment, the reference voltage generation section 100 has a configuration constructed of two PMOS transistors 101 and 102, two NMOS transistors 103 and 104, and a resistor 105.

As in the fourth embodiment, in the present embodiment, when there occurs an abnormally balanced condition, the current value of the reference voltage generation section 100 diminishes and, as a result, the gate voltage of the NMOS transistor 104 falls. At this time, the PMOS transistor 91 enters the conductive state because the gate of the PMOS transistor 91 is common to the NMOS transistor 104, thereby causing current to start flowing in the PMOS transistor 91. This increases the gate voltage of the NMOS transistor 103, thereby causing current to start flowing in the reference voltage generation section 100. In this state, the start-up section 90 stands by in the idle state. At this time, the gate voltage of the PMOS transistor 91 increases. Moreover, it is possible for the PMOS transistor 91 to satisfactorily enter the cut-off state because the source of the PMOS transistor 91 is connected to the voltage VDDD that is sufficiently lower than the power supply voltage VDD of the reference voltage generation section 100. Accordingly, the present embodiment also makes it possible to reduce the current of the start-up section 90 when the start-up section 90 stands by in the idle state, thereby allowing the realization of reference voltage generation circuits with low power consumption.

What is claimed is:

1. A reference voltage generation circuit comprising:

a reference voltage generation section having a current mirror and configured to generate a reference voltage; and a start-up section for restarting said reference voltage generation section;

wherein said start-up section includes a single PMOS transistor for receiving at its gate a voltage at a node which varies with the magnitude of a current flowing in one branch of said current mirror in said reference voltage generation section, and for supplying a start-up current to said reference voltage generation section in order to restart said reference voltage generation section in response to said voltage; and wherein a power supply voltage lower than a power supply voltage of said reference voltage generation section is applied to a source of said PMOS transistor.

* * * * *